US006321829B1

(12) United States Patent
Fujioka et al.

(10) Patent No.: US 6,321,829 B1
(45) Date of Patent: Nov. 27, 2001

(54) BILLET CONTINUOUS CASTING MACHINE AND CASTING METHOD

(75) Inventors: Hironori Fujioka; Hiroshi Nakajima; Masahiro Kassai, all of Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/471,031

(22) Filed: Dec. 23, 1999

Related U.S. Application Data

(62) Division of application No. 09/006,439, filed on Jan. 13, 1998, now Pat. No. 6,024,161.

(30) Foreign Application Priority Data

Apr. 8, 1997 (JP) ..... 9-089401

(51) Int. Cl.[7] ..... B22D 11/08; B22D 11/20

(52) U.S. Cl. ..... 164/483; 164/454; 164/466; 164/486

(58) Field of Search ..... 164/483, 486, 164/413, 444, 502, 454, 466

(56) References Cited

U.S. PATENT DOCUMENTS

| | | | | |
|---|---|---|---|---|
| 3,882,924 | * | 5/1975 | Fujikawa | 164/444 |
| 4,136,728 | | 1/1979 | Schmid | 164/444 |
| 4,787,438 | * | 11/1988 | Flemming et al. | 164/453 |
| 5,004,040 | | 4/1991 | Pleschiutschnigg et al. | 164/413 |
| 5,564,487 | | 10/1996 | Cahill et al. | 164/413 |
| 5,871,040 | * | 2/1999 | Kaseda et al. | 164/486 |

FOREIGN PATENT DOCUMENTS

| | | | |
|---|---|---|---|
| 1483925 | * | 5/1967 | (FR) . |
| 53930 | | 1/1978 | (JP) . |
| 5342287 | | 11/1978 | (JP) . |
| 57106553 U | | 7/1982 | (JP) . |
| 63137547 A | | 6/1988 | (JP) . |
| 63242444 A | | 10/1988 | (JP) . |
| 4319044 A | | 11/1992 | (JP) . |
| 5293597 A | | 11/1993 | (JP) . |
| 6297101 A | | 10/1994 | (JP) . |
| 6297106 A | | 10/1994 | (JP) . |

* cited by examiner

*Primary Examiner*—Nam Nguyen
*Assistant Examiner*—I.-H. Lin

(57) ABSTRACT

A billet continuous casting machine comprises, and a billet continuous casting method uses, a jacket for cooling an outer wall of a quadrangular tubular mold with cooling water, electromagnetic brakes disposed outside the mold for decelerating the flow speed of poured molten metal in the mold, an X ray-based level sensor for detecting the level of molten metal in the mold, notched portions formed at the corners of a quadrangular lower part of the mold, spray nozzles for spraying a cooling liquid directly onto the notched portions, and elastically pushing means for imparting a pushing force corresponding to the static pressure of the molten metal to unnotched portions of the quadrangular lower part of the mold to push the unnotched portions inwardly of the mold, whereby molten metal is continuously poured into the cooled mold to solidify the molten metal so that a cast piece quadrangular in cross section is continuously produced. Delay in solidification at sites near the corners of the cast piece is eliminated, and high quality, high speed casting is realized.

5 Claims, 5 Drawing Sheets

BILLET CONTINUOUS CASTING MACHINE AND CASTING METHOD

This application is a divisional of application Ser. No. 09/006,439, filed on Jan. 13, 1998 and now issued as U.S. Pat. No. 6,024,161, the entire contents of which are hereby incorporated by reference.

BACKGROUND OF THE INVENTION

This invention relates to a billet continuous casting machine and casting method which continuously pour molten metal into a tubular mold to solidify the molten metal, thereby continuously producing a cast piece of a square or rectangular cross sectional shape.

FIG. 7 is an explanatory drawing showing an example of a conventional billet continuous casting machine.

As shown in the drawing, molten metal (molten steel) is poured through a molten metal nozzle 101 into a mold 100. At this time, cooling water is sprayed from a plurality of spray nozzles 102, arranged outside the mold 100, to cool the mold 100. While the molten metal inside the mold 100 is gradually moving downward, its peripheral area is solidified. A cast piece 103 is continuously formed and forced out of the mold 100.

The cooling water is supplied by a pump or the like (not shown) through a cooling water inlet 104 into a jacket 105. The water flowing in the jacket 105 cools the surroundings of the mold 100, or cools the mold 100 by being sprayed from the spray nozzles 102 as mentioned above, and is then discharged through a cooling water outlet 106.

The mold 100 is in a tubular form having a square cross section, and is provided with a linear taper (inclination) ranging from a molten metal inlet at the top of the mold to a cast piece outlet at the bottom of the mold. The taper value of the mold 100 is 1% of less, and a generally used taper value is 0.6 to 0.8%.

As described above, a conventional billet continuous casting machine has the tapered mold 100, and cooling means for cooling the mold, and operates while suitably combining a cooling rate with the taper and the cooling means.

In the conventional billet continuous casting machine, the taper of the mold 100 was relatively small, and low speed casting posed few problems. High speed casting (3 m/min or more), however, caused the following insoluble problems: At the corners of a lower part of the mold 100, air gaps (gaps between the mold and a solid shell which are generated because of the nonuniform growth of the solid shell in the mold; gaps are generated at the corners of the lower part of the mold) appear between the mold 100 and the cast piece 103. Furthermore, the site of delay in solidification occurs in the cast piece from its corners as far as 10 mm or so apart, thereby deteriorating the quality of the product. That is, the occurrence of the air gaps makes the cooling of the cast piece 103 nonuniform, thus inducing deformation, cracks or structure defects of the cast piece 103. The occurrence of the site of solidification delay, moreover, causes rhombic deformation or breakout.

SUMMARY OF THE INVENTION

It is, therefore, an object of the present invention, to provide a billet continuous casting machine and casting method capable of high quality, high speed casting.

To attain this object, the invention provides a billet continuous casting machine comprising cooling means for cooling an outer wall of a tubular mold, electromagnetic brakes disposed outside the mold for decelerating the flow of molten metal poured into the mold, molten metal level detecting means for detecting and controlling the level of molten metal in the mold, notched portions formed at corners of a quadrangular lower part of the mold, and cooling liquid spray means for spraying a cooling liquid directly onto the notched portions; and having elastically pushing means for imparting a pushing force corresponding to the static pressure of the molten metal to unnotched portions of the quadrangular lower part of the mold to push the unnotched portions inwardly of the mold; whereby molten metal is continuously poured into the cooled mold to solidify the molten metal so that a cast piece, quadrangular in cross section, is continuously produced.

Preferably, taper portions are provided in an upper part of the tubular mold.

Preferably, the tubular mold is curved in an arcuate form in the direction to which the cast piece is drawn.

Preferably, the molten metal level detecting means is an X ray- or γ ray-based level sensor which comprises an emitting portion and a receiving portion disposed along nearly diagonal line of the tubular mold and detects the molten metal level at a position unaffected by the flow of molten metal poured through the molten metal nozzle into the mold.

Preferably, controlling means is provided for controlling the speed of cast piece drawn by pinch rolls based on a molten metal level signal from the molten metal level detecting means.

A billet continuous casting method related to the present invention comprises pouring molten metal into a water-cooled tubular mold having notched portions at the corners of a lower part of the mold; pulling out a dummy bar in the mold when a molten metal level signal from molten metal level detecting means has reached a predetermined value of the level in the mold; starting casting while applying electromagnetic brakes to the poured molten metal flow in the mold; decreasing the speed of cast piece drawn by pinch rolls when the molten metal level signal has fallen short of a predetermined value range of the level in the mold; and increasing the drawing speed of cast piece drawing when the molten metal level signal has exceeded the predetermined value range of the level in the mold.

DETAILED DESCRIPTION OF THE PREFERRED EMBODIMENTS

A billet continuous casting machine and casting method related to the present invention will now be described in detail by way of Embodiments using the accompanying drawings.

First Embodiment

<Constitution>

Figure 1:
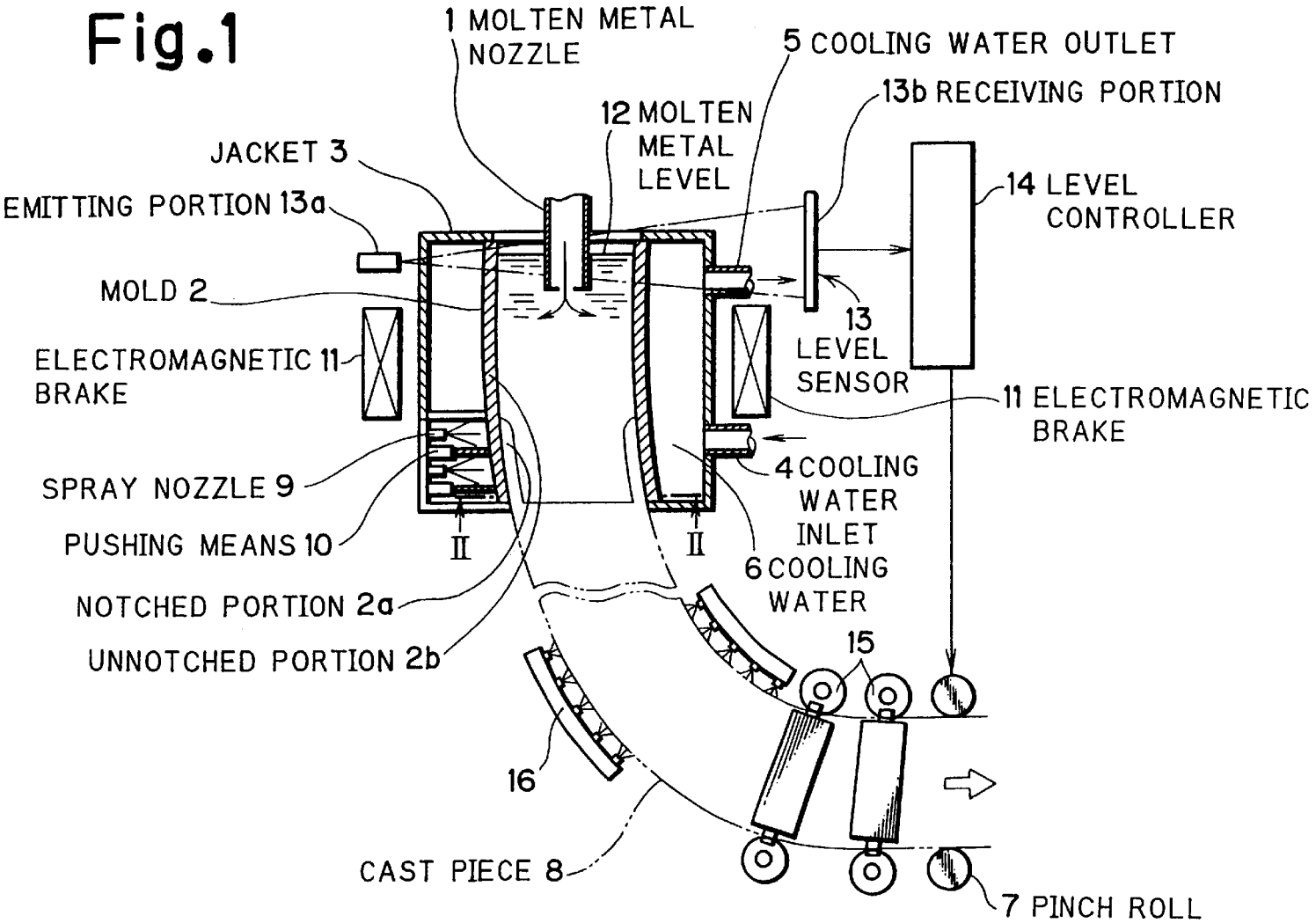
FIG. 1 is a sectional view of a billet continuous casting machine showing a first embodiment of the present invention.
Figure 2:
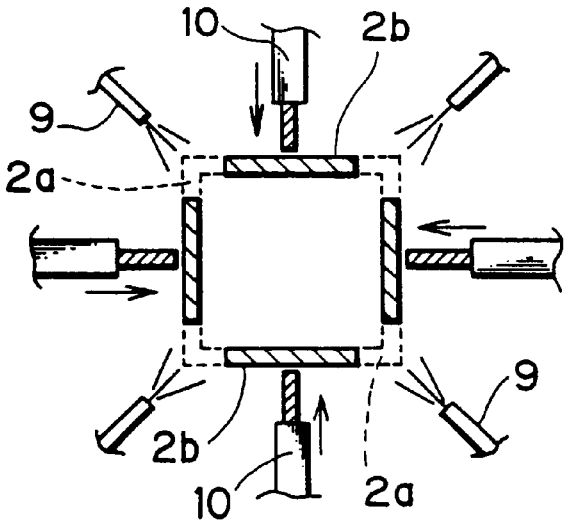
FIG. 2 is a view taken along line II—II of FIG. 1.
Figure 3:
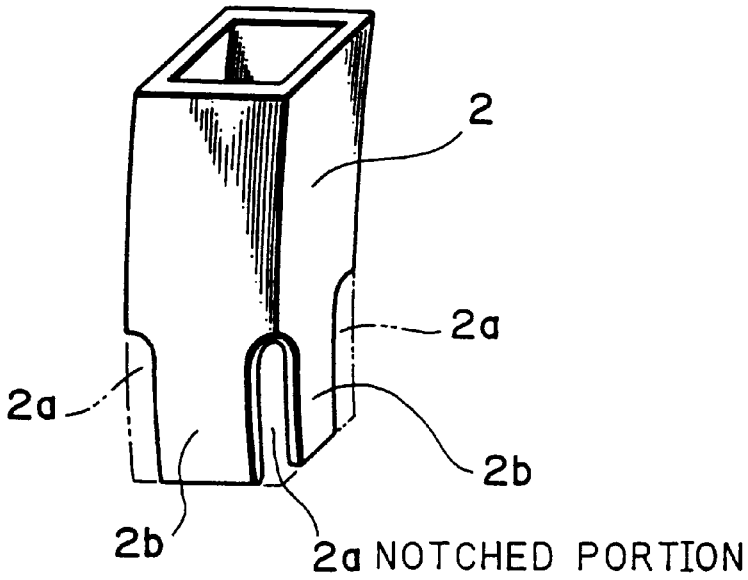
FIG. 3 is a perspective view of a mold of FIG. 1.
Figure 4:
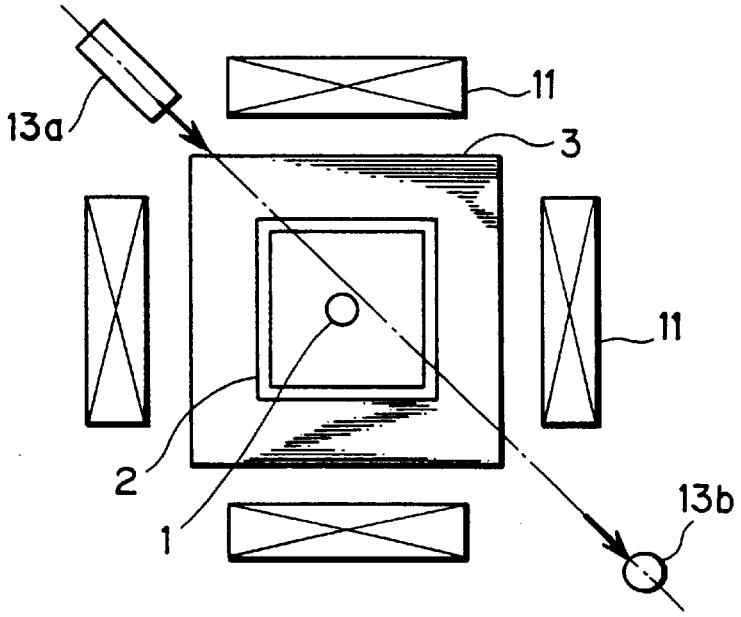
FIG. 4 is a plan view showing molten metal level detecting means of the present invention.
Figure 5:
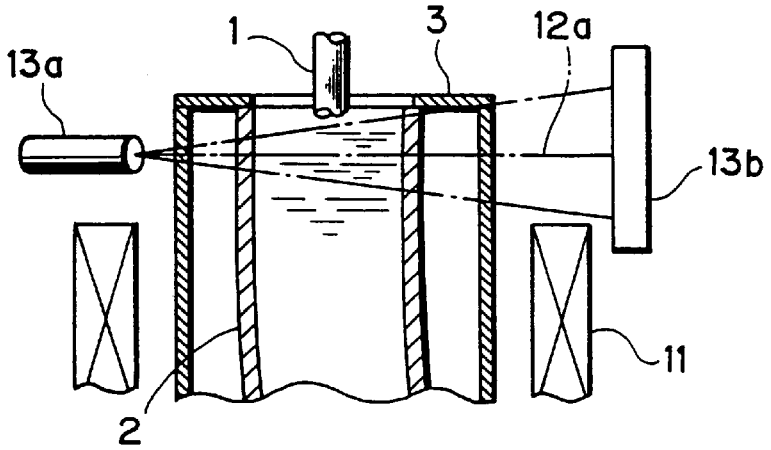
FIG. 5 is a partly sectional front view of the molten metal level detecting means of FIG. 4.

FIG. 1 is a sectional view of a billet continuous casting machine showing a first embodiment of the present invention. FIG. 2 is a view taken along line II—II of FIG. 1. FIG. 3 is a perspective view of a mold of FIG. 1. FIG. 4 is a plan view showing molten metal level detecting means. FIG. 5 is a partly sectional front view of the molten metal level detecting means of FIG. 4.

As shown in FIG. 1, molten metal, such as molten steel, is continuously poured into a mold 2 through a molten metal nozzle 1. The mold 2 is disposed in a jacket 3 constituting cooling means, and is cooled by cooling water 6 supplied into the jacket 3 and circulated therethrough. The cooling water 6 is supplied to the jacket 3 by a cooling water inlet 4 and a cooling water outlet 5.

The mold 2 is formed in the shape of a tube that is curved arcuately in the direction of drawing of a cast piece 8 by pinch rolls 7 and having a quadrangular (square or rectangular) cross section. At the four corners of a quadrangular lower part of the mold 2, notched portions 2*a* having predetermined lengthwise and widthwise dimensions are formed as shown in FIG. 3.

As illustrated in FIG. 2, spray nozzles (cooling liquid spray means) 9 are disposed for directly spraying cooling water onto the molten metal in the mold 2 opposite the respective notched portions 2*a*. Pushing means 10 are also provided for pushing unnotched portions 2*b* of the quadrangular lower part of the mold 2 inwardly of the mold 2 by a force corresponding to the static pressure of the molten metal.

The pushing means 10 are each constituted such that a push rod or the like is urged by a spring, air cylinder or the like. If the cast piece 8 swells abnormally, the pushing means 10 allow the escape of the unnotched portions 2*b* to enable the drawing of the cast piece 8.

Outside the jacket 3, electromagnetic brakes 11 are disposed for decelerating the speed of the flow of the poured molten metal in the mold 2, and an X ray (or γ ray)-based level sensor (molten metal level detecting means) 13 is disposed for detecting the level of molten metal (meniscus) 12 in the mold 2.

The electromagnetic brakes 11 decelerate the flow speed of the poured molten metal by a magnetic field acting on the poured molten metal perpendicularly. As shown in FIG. 4, the electromagnetic brakes 11 are disposed at four sites on the outer periphery of the jacket 3.

The level sensor 13 detects the position of the molten metal level in such a manner that its emitting portion 13*a* emits X rays (or γ rays) toward the level 12 of molten metal in the mold 2 and its receiving portion 13*b* receives a level image of the molten metal level 12. As shown in FIG. 4, the emitting portion 13*a* and the receiving portion 13*b* are placed at a space where the electromagnetic brakes 11 are not disposed, namely, on a nearly diagonal line of the jacket 3 (mold 2). Furthermore, the level sensor 13 detects the molten metal level 12 at a position unaffected by the flow of molten metal from the molten metal nozzle 1 into the mold 2 (i.e., the position of the molten metal level; at this position, the site where molten metal is present and the site where molten metal is absent are sensed, whereby the right position of the molten metal level can be measured). The emitting portion 13*a* and the receiving portion 13*b* are disposed at positions at which they can detect the range of changes in the molten metal level with a reference surface 12*a* falling within the range, without being interfered by the electromagnetic brakes 11, as shown in FIG. 5.

A signal indicative of the molten metal level detected by the receiving portion 13*b* is entered in a level controller (controlling means) 14. The level controller 14 variably controls the speed of cast piece drawn by the pinch rolls 7 based on the molten metal level signal. Thus, the level controller 14 performs a feedback control so that the molten metal level 12 is within a predetermined range.

That is, the level controller 14 decreases the speed of cast piece drawn by the pinch rolls 7 when the molten metal level signal indicates that the level 12 has fallen short of the predetermined in the mold, and increases the speed when the molten metal level signal indicates that the level 12 has exceeded the predetermined range in the mold 2. Thus, the level controller 14 always maintains the molten metal level 12 in the predetermined range.

In FIG. 1, the numeral 15 denotes a guide rollers for feeding the cast piece 8 discharged from the cast piece outlet of the mold 2 to the pinch rolls 7 while arcuately guiding the cast pieces. The numeral 16 denotes cooling water sprays. The electromagnetic brakes 11 and the level sensor 13 preferably have cooling water flow equipment for self-cooling. Into the aforementioned cast piece outlet, a dummy bar (not shown) is inserted for serving as a molten metal stopper before the start of casting and a guide for cast piece drawing.

<Actions·Effects>

The foregoing billet continuous casting machine is generally operated in the following manner:

① Preparations for the start of casting are completed (insertion of the dummy bar into the mold 2, setting of cooling materials, flow of cooling water into the jacket 3, and the spray nozzle 9, etc.).

② The level sensor 13 is turned on.

③ Molten metal is poured into the mold 2 through the molten metal nozzle 1.

④ After the reference molten metal level 12*a* is detected by the level sensor 13, the dummy bar is pulled out, and vibrations of the mold 2 are started.

⑤ At a time when the dummy bar leaves the mold 2, the electromagnetic brakes 11 are energized.

⑥ The respective devices are operated at their set values, and the cast piece 8 is continuously produced.

Upon completion of casting, the following procedure is performed:

① The pouring of molten metal is stopped.

② Energization of the electromagnetic brakes 11 is terminated.

③ The level sensor 13 is turned off.

④ After the cast piece 8 goes out of the mold 2, the vibrations of the mold 2, and the flow of cooling water into the jacket 3 and spray nozzles 9 is stopped.

According to the billet continuous casting machine of the instant embodiment, when molten metal is continuously poured into the mold 2, the flow speed of the poured molten metal in the mold 2 is decelerated by the electromagnetic brakes 11. This results in a uniformly thick solidified film formed on the entire peripheral surface of the cast piece 8 in contact with the mold. Thus, the quality of the cast piece 8, particularly under high speed casting, improves. If there are none of the electromagnetic brakes 11, the initial thickness of the solidified film is small locally. As solidification proceeds, as a bend or the like of the cast piece 8 occurs, it becomes impossible to keep the quality of the cast piece 8 constant. The output of the electromagnetic brakes 11 is constant with a central magnetic flux density of 0.2 T (tesla) or more and a frequency of 2.5 hertz or less. These set values are suitably varied according to the shape of the mold.

In the instant embodiment, moreover, cooling water is sprayed by the spray nozzle 9 onto the notched portions 2*a*, formed at the corners of the mold lower part, to directly cool the corners of the cast piece 8. As a result, the cooling of the corners of the cast piece 8 is quickened, and the growth of a solid shell at the corners is promoted. Thus, the delay in solidification at sites near the corners of the case piece during high speed casting is eliminated.

In addition, the unnotched portions 2*b* of the mold lower part are pushed by the pushing means 10 inwardly of the mold 2 at a force comparable to the static pressure of the molten metal. Consequently, the expansion of the cast piece and the occurrence of air gaps are prevented, and the quality of the cast piece 8 is improved.

The level 12 of molten metal in the mold 2 changes with the casting speed of the cast piece 8 (the speed of cast piece drawn by the pinch rolls 7). The amount of this change is detected by the X ray (or γ ray) -based level sensor 13. That is, when X ray (or γ ray) is emitted by the emitting portion 13*a* toward the molten metal level 12 in the mold 2, a level image of the molten metal level 12 is received by the receiving portion 13*b* to detect the position of the molten metal level. The resulting detection signal is fed back by the level controller 14 to control the casting speed of the cast piece 8 as stated earlier.

As a result, the molten metal level in the mold 2 is always kept in the predetermined range. Thus, the cooling action for the molten metal via the mold 2 is properly performed, and high speed, high quality cast piece production can be performed continuously and stably.

Also, the level sensor 13 for detecting the molten metal level 12 is disposed at a position nearly diagonal with respect to the mold 2 and unaffected by the flow of the poured molten metal. Thus, the molten metal level 12 can be detected accurately. Furthermore, the X ray(or γ ray)-based level sensor 13 is used, so that the time delay of detection is small, which results in a quick response.

In the instant embodiment, the mold 2 is curved in an arcuate form in the drawing direction of the cast piece 8, drawn by the pinch rolls 7. Thus, the cast piece 8 can be drawn downward in a curved condition from the beginning. Hence, stress, when curving the cast piece 8 by means of the guide roller 15, can be decreased, and the height of the continuous casting machine itself can be reduced.

In this manner, while the molten metal in the mold 2 is gradually moving downward, its peripheral part is solidified to form a solid shell having a uniform thickness. The resulting cast piece 8 is continuously withdrawn from the cast piece outlet.

Experimental Example

Experimental Example is given below.

Mold (2): Made of copper (150 mm square×1,100 mm in length)

Notched portion (2*a*): 300 mm from the bottom of the corner of the mold×30 mm in width)

Amount of water from spray nozzle (9): 150 liters/min

Casting speed: 5 m/min

Mold vibrations: 300 cycles/min, amplitude ± 3 mm

Level gauge: X ray-based level sensor (12)

Electromagnetic brake (11): Magnetic flux density 2,000 gausses, frequency 1 Hz, two-phase (phase difference 90°) energization Cast piece (8): Carbon steel (0.2%C)

Experiments conducted under these conditions demonstrated that continuous casting could be performed stably at a higher casting speed of 5 m/min higher than a conventional casting speed (3 m/min). Thus, high speed casting became possible without any harmful defects, such as cracks, in a cast piece 8 taken out of the mold 2.

Second Embodiment

Figure 6:
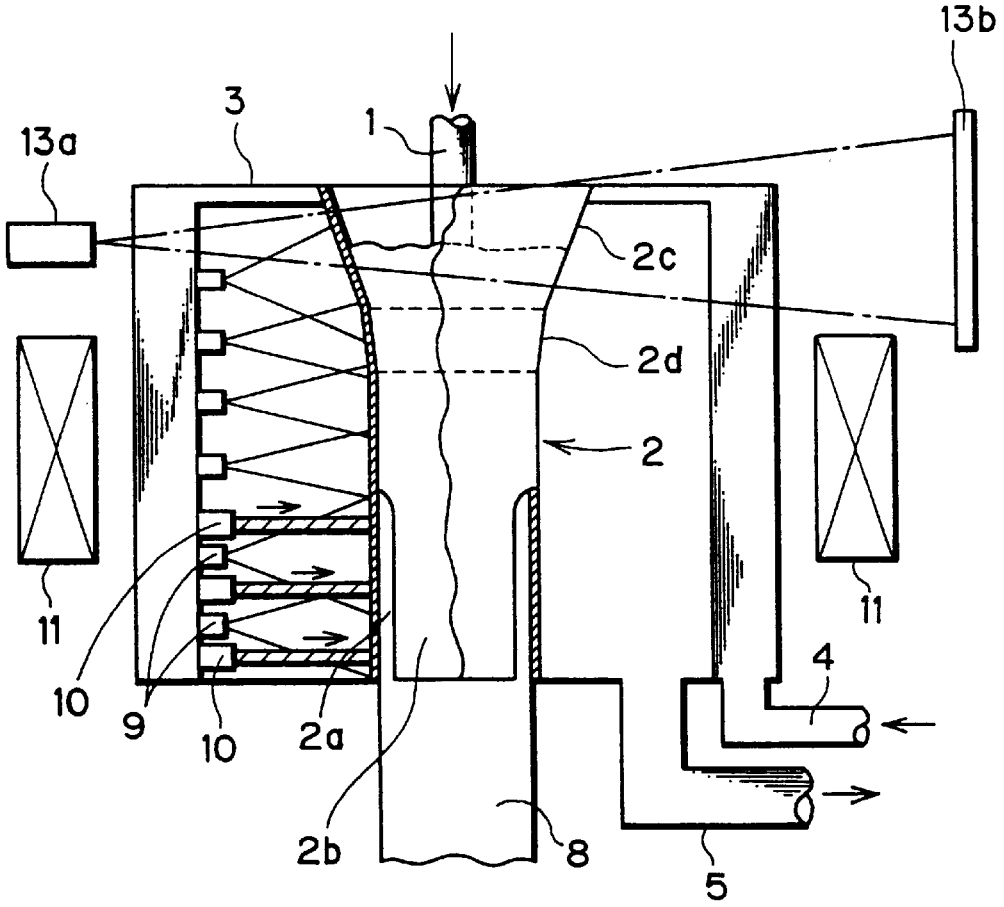
FIG. 6 is a sectional view of an essential part of a billet continuous casting machine showing a second embodiment of the present invention.
Figure 7:
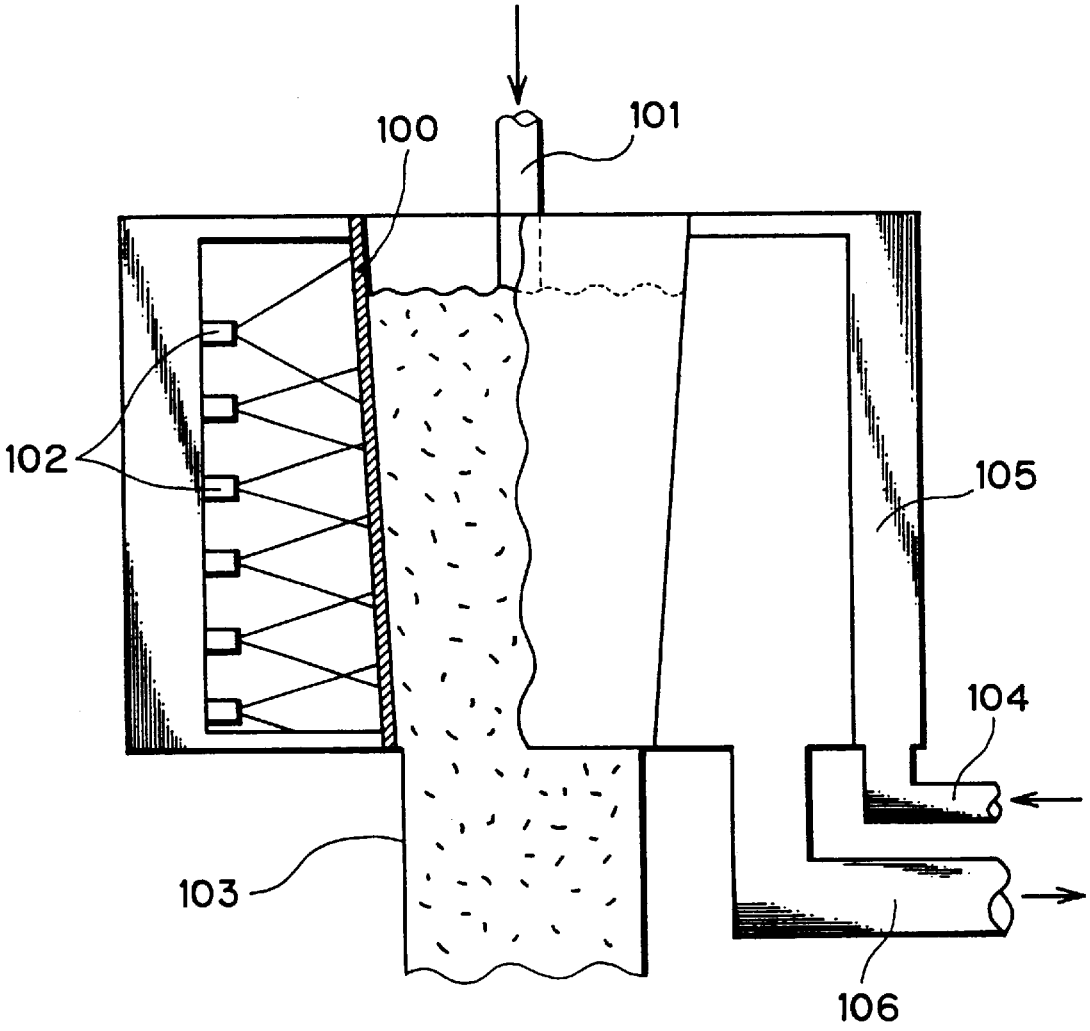
Fig.7 PRIOR ART
FIG. 7 is an explanatory drawing showing a conventional billet continuous casting machine.

FIG. 6 is a sectional view of a billet continuous casting machine showing a second embodiment of the present invention.

This is an embodiment in which the spray nozzles 9 in the first embodiment are used for cooling the entire mold 2, and two taper portions 2*c*, 2*d* with different taper values were provided in an upper part of the mold 2. The other constitutions are the same as in the first embodiment.

According to this embodiment, the taper values of the two taper portions 2*c*, 2*d* are agreed with the solidifying speed of molten metal, and the taper value of the lower taper portion 2*d* is always smaller than that of the upper taper portion 2*c*. Thus, molten metal moves smoothly to the downward cast piece outlet, and the amount of air gaps between the mold 2 and the cast piece 8 decreases. This brings the advantage that the cooling rate of the cast piece 8 can be made uniform. Other actions and effects are the same as in the first embodiment.

The present invention is not restricted to the above-described embodiments, and various changes and modifications, such as the morphological change of the mold and the change of the cooling means, may be made without departing from the gist of the invention.

To summarize the present invention comprises cooling means for cooling an outer wall of a tubular mold, electromagnetic brakes disposed outside the mold for decelerating the flow of poured molten metal in the mold, molten metal level detecting means for detecting and controlling the level of molten metal in the mold, notched portions formed at corners of a quadrangular lower part of the mold, and cooling liquid spray means for spraying a cooling liquid directly onto the notched portions; and having elastically pushing means for imparting a pushing force corresponding to the static pressure of the molten metal to unnotched portions of the quadrangular lower part of the mold to push the unnotched portions inwardly of the mold; whereby molten metal is continuously poured into the cooled mold to solidify the molten metal so that a cast piece, quadrangular in cross section, is continuously produced. Thus, the following advantages are obtained:

① The flow of molten metal, poured through the molten metal nozzle speeds up according to high speed casting. This flow speed is decelerated by the electromagnetic brakes, and deformation of the cast piece, associated with fluctuations in the molten metal level and remelting of the cast piece is prevented.

② In the conventional apparatus, at the corners of the cast piece, gaps are formed between the cast piece and the mold because of the solidification and shrinkage of the cast piece. As a result, insufficient cooling results, the cast piece thins, and breakout or deformation is apt to occur especially during high speed casting. These disadvantages can be prevented by notching the mold, and cooling the corners of the cast piece with sprayed water at an early stage.

③ The corners of the lower part of the mold are notched to bring the unnotched portions of the mold into constant contact with the cast piece. By this measure, the thickness of the cast piece that tends to decrease during high speed casting can be increased.

Thus, a billet continuous casting machine, capable of high quality, high speed casting, can be realized.

Furthermore, taper portions are provided in an upper part of the tubular mold. Thus, molten metal is moved smoothly to the downward cast piece outlet in accordance with the solidification speed, and the amount of air gaps between the mold and the cast piece decreases. Consequently, the cooling rate of the cast piece can be made uniform.

Furthermore, the tubular mold is curved in an arcuate form in the direction of drawing of the cast piece. Thus, the cast piece can be drawn downward in a curved condition from the beginning. Hence, stress that occurs when curving the cast piece by means of the guide roller can be decreased, and the height of the continuous casting machine itself can be reduced.

Furthermore, the molten metal level detecting means is the X ray- or γ ray-based level sensor which comprises the emitting portion and the receiving portion disposed nearly diagonal with respect to the tubular mold and which detects the molten metal level at a position unaffected by the flow of molten metal poured from the molten metal nozzle into the mold. Thus, its response to fluctuations in the molten metal level is quick, permitting molten metal level control with a delay in response which is only about a tenth of that of conventional means. Higher speed casting than before is possible.

Furthermore, the controlling means is provided for controlling the speed of cast piece drawn by pinch rolls based on a molten metal level signal from the molten metal level detecting means. Thus, the molten metal level, in the mold, is always kept within a predetermined range in the mold. Also, the cooling action for the molten metal via the mold 2 is properly performed. Hence, high quality, high speed cast piece production can be performed continuously in a stabilized manner.

The billet continuous casting method related to the present invention comprises pouring molten metal into a water-cooled tubular mold having notched portions at the corners of a lower part of the mold; pulling out a dummy bar in the mold when a molten metal level signal from molten metal level detecting means has reached a predetermined value of the level in the mold; starting casting while applying electromagnetic brakes to the poured molten metal flow in the mold; decreasing the speed of cast piece drawn by pinch rolls when the molten metal level signal has fallen short of a predetermined value range of the level in the mold; and increasing the drawing speed of cast piece when the molten metal level signal has exceeded the predetermined value range of the level in the mold. Thus, the molten metal level in the mold is always kept within the predetermined range. Also, the cooling action for the molten metal via the mold is properly performed. Hence, high quality, high speed cast piece production can be performed continuously in a stabilized manner.

What is claimed is:

1. A billet continuous casting method, comprising:

providing a water-cooled tubular mold having notched portions at corners of a lower part of the mold;

providing a molten metal level detecting unit that outputs a molten metal level signal indicative of a level of molten metal in the mold;

pouring molten metal into the mold;

starting casting while applying electromagnetic brakes to the poured molten metal flow in the mold;

decreasing drawing speed of cast piece by pinch rolls when the molten metal level signal has fallen short of a predetermined value range of the level in the mold;

increasing the drawing speed of cast piece when the molten metal level signal has exceeded the predetermined value range of the level in the mold; and elastically imparting a pushing force corresponding to static pressure of the molten metal to unnotched portions at the lower part of the mold in an inward direction of the mold, whereby the molten metal is continuously poured into the mold to solidify the molten metal so that a cast piece quadrangular in cross section is continuously produced.

2. The billet continuous casting method, according to claim 1, further comprising:

pulling out a dummy bar in the mold, to initiate casting, when the molten metal level signal from the molten metal level detecting unit has reached a predetermined value of the level in the mold.

3. The billet continuous casting method according to claim 1, wherein said providing step includes the step of providing taper portions in an upper part of the tubular mold.

4. The billet continuous casting method according to claim 1, wherein said providing step includes the step of providing the tubular mold curved in an arcuate form in the direction of drawing of the cast piece.

5. The billet continuous casting method according to claim 1, wherein said molten metal level detecting unit providing step includes the steps of, providing an emitting portion and a receiving portion at positions nearly diagonal with respect to the mold, and detecting the level of molten metal at a position unaffected by the flow of the molten metal poured into the mold.

* * * * *